US006775870B2

(12) United States Patent
Gayme et al.

(10) Patent No.: US 6,775,870 B2
(45) Date of Patent: Aug. 17, 2004

(54) DATA MANIPULATION METHOD AND SYSTEM FOR A SELF-BALANCING ROTATABLE APPARATUS

(75) Inventors: Dennice F. Gayme, St. Paul, MN (US); Kevin J. Stalsberg, White Bear Lake, MN (US)

(73) Assignee: Honeywell International Inc., Morristown, NJ (US)

( * ) Notice: Subject to any disclaimer, the term of this patent is extended or adjusted under 35 U.S.C. 154(b) by 322 days.

(21) Appl. No.: 10/000,882

(22) Filed: Nov. 15, 2001

(65) Prior Publication Data

US 2003/0101519 A1 Jun. 5, 2003

(51) Int. Cl.[7] ..... D06F 33/00
(52) U.S. Cl. ..... 8/159; 8/158
(58) Field of Search ..... 8/159, 158; 68/12.06, 68/23.2, 23.3; 210/144; 74/573 R, 574; 494/82

(56) References Cited

U.S. PATENT DOCUMENTS

| | | | | |
|---|---|---|---|---|
| 3,799,348 A | | 3/1974 | Mazza | 210/144 |
| 3,983,035 A | | 9/1976 | Arkeveld et al. | 210/138 |
| 4,000,658 A | | 1/1977 | Schmidt | 73/490 |
| 4,157,781 A | | 6/1979 | Maruyama | 233/23 A |
| 4,322,641 A | | 3/1982 | Packard | 307/521 |
| 4,694,156 A | | 9/1987 | Swanberg | 250/214 |
| 4,991,247 A | | 2/1991 | Castwall et al. | 8/158 |
| 5,150,314 A | | 9/1992 | Garratt et al. | 364/571.02 |
| 5,280,660 A | | 1/1994 | Pellerin et al. | 8/158 |
| 5,325,677 A | | 7/1994 | Payne et al. | 68/12.04 |
| 5,376,063 A | | 12/1994 | Greenstein | 494/37 |
| 5,490,436 A | | 2/1996 | Coyne et al. | 74/573 |
| 5,561,993 A | | 10/1996 | Elgersma et al. | 68/23.2 |
| 5,582,040 A | | 12/1996 | Khan | 68/23.2 |
| 5,692,313 A | | 12/1997 | Ikeda et al. | 34/58 |
| 5,715,731 A | | 2/1998 | Koch | 74/573 |
| 5,729,025 A | | 3/1998 | Erickson et al. | 250/574 |
| 5,731,868 A | | 3/1998 | Okey et al. | 356/73 |
| 5,757,481 A | | 5/1998 | O'Brien et al. | 356/243 |
| 5,761,932 A | | 6/1998 | Kim | 68/23.2 |
| 5,761,933 A | | 6/1998 | Kim et al. | 68/23.2 |
| 5,765,402 A | | 6/1998 | Ikeda et al. | 68/12.06 |
| 5,800,628 A | | 9/1998 | Erickson et al. | 134/18 |
| 5,850,748 A | | 12/1998 | Kim et al. | 68/23.2 |
| 5,862,553 A | | 1/1999 | Haberl et al. | 8/159 |
| 5,870,907 A | | 2/1999 | Cho | 68/23.1 |
| 5,879,279 A | * | 3/1999 | Berger et al. | 494/7 |
| 5,893,280 A | | 4/1999 | Honda et al. | 68/12.06 |
| 5,913,951 A | | 6/1999 | Herr et al. | 8/158 |
| 5,921,148 A | | 7/1999 | Howell | 74/573 |

(List continued on next page.)

FOREIGN PATENT DOCUMENTS

| | | | |
|---|---|---|---|
| EP | 1 036 875 A2 | 9/2000 | D06F/39/08 |

*Primary Examiner*—Frankie L. Stinson
*Assistant Examiner*—Joseph L. Perrin
(74) *Attorney, Agent, or Firm*—Kris T. Fredrick; Kermit D. Lopez; Luis M. Ortiz

(57) ABSTRACT

A method and system for dynamically balancing a rotating system, such that sensor measurements and responses to control actions can be compiled utilizing one or more sensors associated with the rotating system. The rotating system may be represented utilizing sensor measurements and responses to control actions through an associated control model, such that the control model and the sensor measurements are determinative of future control actions. The rotating system may be perturbed utilizing a control action while improving a balance condition associated with the rotating system. Sensor data may be measured from one or more sensors associated with the rotating system. Responses thereof may be determined based on the control action. The sensor data may be manipulated in order to remove measurements and responses thereof that do not well-represent the rotating system.

20 Claims, 8 Drawing Sheets

U.S. PATENT DOCUMENTS 5,923,433 A 7/1999 Giuffre et al. ..... 356/440
5,957,144 A 9/1999 Neff et al. ..... 134/56 D
5,960,804 A 10/1999 Cooper et al. ..... 134/56 D
5,979,236 A 11/1999 Hong et al. ..... 73/458
6,007,640 A 12/1999 Neff et al. ..... 134/18
6,029,300 A 2/2000 Kawaguchi et al. ..... 8/159
6,047,428 A 4/2000 Min ..... 8/159
6,077,423 A 6/2000 Roy et al. ..... 210/121
6,082,151 A 7/2000 Wierzba et al. ..... 68/23.2
6,129,768 A 10/2000 Johnson et al. ..... 8/159
6,130,928 A 10/2000 Jamzadeh et al. ..... 377/23
6,144,447 A 11/2000 Ohman et al. ..... 356/246
6,148,647 A 11/2000 Kabeya et al. ..... 68/140
6,159,384 A 12/2000 Roberts et al. ..... 210/741
6,350,224 B1 * 2/2002 Cordaro et al. ..... 494/7
6,477,867 B1 * 11/2002 Collecutt et al. ..... 68/12.06
6,578,225 B2 * 6/2003 Jonsson ..... 8/159

* cited by examiner

DATA MANIPULATION METHOD AND SYSTEM FOR A SELF-BALANCING ROTATABLE APPARATUS

RELATED APPLICATIONS

This application is related to co-pending and co-owned patent applications entitled: 'Method and Apparatus for Reducing Microprocessor Speed Requirements in Data Acquisition Applications,' U.S. Ser. No. 09/792,996, filed on Feb. 26, 2001; 'Method and System for Detecting Fluid Injection from Stationary to Rotating Members,' U.S. Ser. No. 09/951,790, filed on Sep. 10, 2001; 'Simultaneous Injection Method and System for a Self-Balancing Rotatable Apparatus,' U.S. Ser. No. 09/896,763, filed on Jun. 29, 2001; 'Energy-Based Thresholds Applied to Dynamic Balancing,' U.S. Ser. No. 09/951,798, filed on Sep. 10, 2001; 'Dynamic Correlation Extension for a Self-Balancing Rotatable Apparatus' U.S. Ser. No. 09/951,932, filed on Sep. 10, 2001; 'Continuous Flow Method and System for Placement of Balancing Fluid on a Rotating Device Requiring Dynamic Balancing', U.S. Ser. No. 10/001,006, filed on Nov. 15, 2001; 'Dynamic Balancing Application Mass Placement', U.S. Ser. No. 10/001,090, filed on Nov. 15, 2001; 'Fixed-Bandwidth Correlation Window Method and System for a Self-Balancing Rotatable Apparatus,' U.S. Ser. No. 09/999,594, filed on Nov. 15, 2001; 'Supervisory Method and System for Improved Control Model Updates Applied to Dynamic Balancing,' U.S. Ser. No. 10/011,218, filed on Nov. 15, 2001; 'Resonance Identification Extension for a Self-Balancing Rotatable Apparatus,' U.S. Ser. No. 10/001,098, filed on Nov. 15, 2001; 'Method and System for Mechanizing Simultaneous Multi-Actuator Actions Applied to Dynamic Balancing,' U.S. Ser. No. 10/000,255, filed on Nov. 15, 2001.

TECHNICAL FIELD

The present invention relates generally to rotatable members that are able to achieve balanced conditions throughout a range of rotational speeds. The present invention also relates to methods and systems for dynamically balancing rotatable members through the continual determination of out-of-balance forces and motion to thereby take corresponding counter balancing action. The present invention additionally relates to methods and systems in which inertial masses are actively shifted within a body rotating on a shaft in order to cancel rotational imbalances associated with the shaft and bodies co-rotating thereon. The present invention additionally relates to methods and systems for dynamic balancing, utilizing a data manipulation method to achieve a balanced state more quickly.

BACKGROUND OF THE INVENTION

When rotatable objects are not in perfect balance, non-symmetrical mass distribution creates out-of-balance forces because of the centrifugal forces that result from rotation of the object. This mass unbalance leads to machine vibrations that are synchronous with the rotational speed. These vibrations can lead to excessive wear and unacceptable levels of noise. Typical imbalances in large, rotating machines are on the order of one inch-pound.

It is a common practice to balance a rotatable body by adjusting a distribution of moveable, inertial masses attached to the body. In general this state of balance may remain until there is a disturbance to the system. A vehicle tire, for instance, can be balanced once by applying weights to it and the tire will remain balanced until it hits a very big bump or the weights are removed. However, certain types of bodies that have been balanced in this manner will generally remain in balance only for a limited range of rotational velocities. One such body is a centrifuge for fluid extraction, which can change the degree of balance as speed is increased and more fluid is extracted.

Many machines are also configured as freestanding spring mass systems in which different components thereof pass through resonance ranges during which the machine may become out of balance. Additionally, such machines may include a rotating body loosely coupled to the end of a flexible shaft rather than fixed to the shaft, as in the case of a tire. Thus, moments about a bearing shaft may also be created merely by the weight of the shaft. A flexible shaft rotating at speeds above half of its first critical speed can generally assume significant deformations, which adds to the imbalance. This often poses problems in the operation of large turbines and turbo generators.

Machines of this kind usually operate above their first critical speed. As a consequence, machines that are initially balanced at relatively low speeds may tend to vibrate excessively as they approach full operating speed. Additionally, if one balances to an acceptable level rather than to a perfect condition (which is difficult to measure), the small remaining "out-of-balance" will progressively apply greater force as the speed increases. This increase in force is due to the fact that F is proportional to $r\omega^2$ (note that F is the out-of-balance force, r is the radius of the rotating body and $\omega$ is its rotational speed).

The mass unbalance distributed along the length of a rotating body gives rise to a rotating force vector at each of the bearings that support the body. In general, the force vectors at respective bearings are not in phase. At each bearing, the rotating force vector may be opposed by a rotating reaction force, which can be transmitted to the bearing supports as noise and vibration. The purpose of active, dynamic balancing is to shift an inertial mass to the appropriate radial eccentricity and angular position for canceling the net unbalance. At the appropriate radial and angular distribution, the inertial mass can generate a rotating centrifugal force vector equal in magnitude and phase to the reaction force referred to above. Although rotatable objects find use in many different applications, one particular application is a rotating drum of a washing machine.

Many different types of balancing schemes are known to those skilled in the art. U.S. Pat. No. 5,561,993, which was issued to Elgersma et al. on Oct. 22, 1996, and is incorporated herein by reference, discloses a self-balancing rotatable apparatus. Elgersma et al. disclosed a method and system for measuring forces and motion via accelerations at various locations in a system. The forces and moments were balanced through the use of a matrix manipulation technique for determining appropriate counterbalance forces located at two axial positions of the rotatable member. The method and system described in Elgersma et al. accounted for possible accelerations of a machine, such as a washing machine, which could not otherwise be accomplished if the motion of the machine were not measured. Such a method and system was operable in association with machines not rigidly attached to immovable objects, such as concrete floors. The algorithm disclosed by Elgersma et al. permitted counterbalance forces to be calculated even when the rotating system (such as a washing machine) was located on a flexible or mobile floor structure combined with carpet and padding between the washing machine and a rigid support structure.

U.S. Pat. No. 5,561,993 thus described a dynamic balance control algorithm for balancing a centrifuge for fluid extraction. To accomplish such balance control, sensor responses to balancing control actions on a centrifuge were modeled and utilized to determine control actions that would serve to drive an associated system toward a balanced state. Such a system is generally time variant, such that the control models utilized therein may need to be routinely updated based on the measured response to a previous control action, which is a variation of perturbation theory, well known in the art.

The control algorithm explained in U.S. Pat. No. 5,561,993 also presented a scaling scheme that considered only the threshold-normalized change in sensor value when creating the control model. This did not address issues relating to measurement accuracy and sensor resolution that may result in bad information being supplied to the control model. The creation of control models using poor information may result in poor models that provide inadequate predictions. Based on the foregoing, it can be appreciated that these sensor-related issues can lead to lengthy balancing times and the inability to obtain maximum spin speeds in centrifuge environments, such as, for example, a washing machine, and that improved balance times can be achieved by addressing these issues.

BRIEF SUMMARY OF THE INVENTION

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

It is one aspect of the present invention to provide methods and systems in which rotatable members can achieve balanced conditions throughout a range of rotational speeds.

It is another aspect of the present invention to provide methods and systems for dynamically balancing rotatable members through the continual determination of out-of-balance forces and motion to thereby take corresponding counter balance action.

It is still another aspect of the present invention to provide methods and systems for dynamic balancing rotatable members through a method of data manipulation whereby responses to control actuator actions are either accentuated or diminished such that a balanced state is achieved in a shorter period of time.

In accordance with various aspects of the present invention, methods and systems are disclosed herein for dynamically updating a control model for controlling a balance state of a rotating device or rotating system. Sensor responses can be utilized to define a control model that, along with sensor measurements, can be used to determine control actions that drive the rotatable apparatus to a balanced state and provide new sensor responses.

This invention provides a simple strategy for data manipulation that improves the information used to create the control model, thus improving the effectiveness of the control model, so as to decrease balance times and reduce the possibilities of not attaining the maximum spin speeds. The critical components of this invention include zeroing sensor measurements and changes in sensor measurements below some multiple of the sensor error band and sensor noise floor. Other critical components of the invention involve applying scaling factors to certain sensors to emphasize and de-emphasize certain sensors based on the current operating conditions of the system. The method that is presented for dynamically manipulating the data may be used to force the control system to pay closer attention to certain sensors either for safety reasons or to force the algorithm to converge faster.

The collection of these methods and systems ensures that good data is used to create the control model and that critical inputs are given priority in making control model updates. Both of these factors lead to a more accurate control model under changing system conditions and thereby lead to decreased balance times and facilitating the achievement of maximum spin speeds in a rotating system.

BRIEF DESCRIPTION OF THE DRAWINGS

The accompanying figures, in which like reference numerals refer to identical or functionally similar elements throughout the separate views and which are incorporated in and form part of the specification, further illustrate the present invention and, together with the detailed description of the invention, serve to explain the principles of the present invention.

DETAILED DESCRIPTION OF THE INVENTION

The particular values and configurations discussed in these non-limiting examples can be varied and are cited merely to illustrate embodiments of the present invention and are not intended to limit the scope of the invention.

The present invention involves the formulation of a general model to predict the location of an out-of-balance occurrence based on known perturbations at predetermined locations of a rotatable member. The basic configuration and concepts explained in U.S. Pat. No. 5,561,993 are discussed herein, but do not limit the scope of the present invention, including preferred embodiments discussed herein. Features taught in U.S. Pat. No. 5,561,993 are discussed herein for illustrative purposes only, in order to explain the foundation from which the present invention was derived. Those skilled in the art can appreciate that such features, including figures, text, descriptions, equations and tables thereof do not limit the scope of the present invention.

Figure 1:
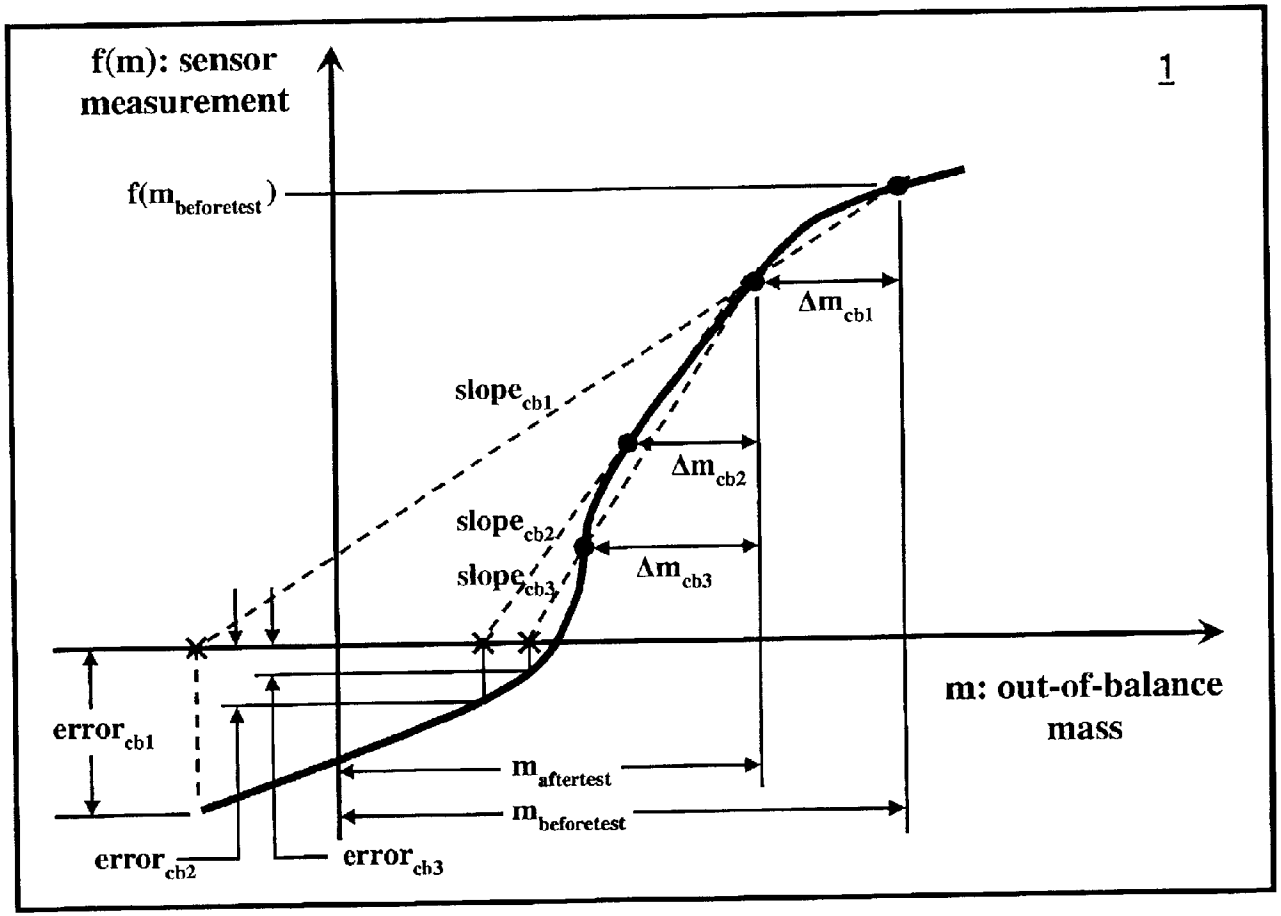
FIG. 1 depicts a plot of a non-linear system, in accordance with preferred embodiments of the present invention.

FIG. 1 depicts a plot of a non-linear system 1, in accordance with preferred embodiments of the present invention.

Given a very simple (e.g., one-dimensional) non-linear system, such as the non-linear system in FIG. 1, the system can be balanced when the sensor measurement, f(m), is driven to zero. The objective of such a system is to find a value for a counterbalance Δm, such that the sensor measurement f(m) is driven to zero, i.e., f(m)=0. Utilizing a Taylor's series expansion in the vicinity of the anticipated operating range and neglecting second order and higher terms, one can generate a linear model of the form y=b+mx. The linear model can be written to reflect the example illustrated in FIG. 1, where several possible line estimates are shown; equation 1 expresses this relationship.

$$f(m_{next}) \approx f(m_{aftertest}) + \left(\frac{\partial f(m)}{\partial m}\right) \cdot (m_{next} - m_{aftertest}) \tag{1}$$

Those skilled in the art can appreciate that $f(m_{next})$ represents the desired sensor measurement. In addition, $f(m_{aftertest})$ can represent the sensor measurement after a test or a prior balance-control action. The variable m generally represents the out-of-balance in the system. For example, the variable $m_{aftertest}$ generally represents the out-of-balance after a test action ($\alpha m_{test}$), and the change in m (i.e., $\Delta m = m_{next} - m_{aftertest}$) is the counterbalance required to achieve a desired sensor measurement, ($f(m_{next})=0$). The control action involves progressively moving in the direction of the estimated counterbalance and updating the system model and the required counterbalance estimate as control progresses. Those skilled in the art can appreciate that this control implementation of equation 1 represents the well-known Newton Raphson iteration method.

Since the objective is to find $f(m_{next})=0$, the general form of equation 1 reduces to:

$$m_{next} = m_{aftertest} - \left[\frac{\partial f(m)}{\partial m}\right]^{-1} \cdot f(m_{aftertest}) \tag{2}$$

where $m_{next}$ is the solution or system out-of-balance needed to make $f(m_{next})=0$ or to drive the sensor measurement to zero. Thus, the estimated mass change $\Delta m_{cb}$ generally required for counterbalance action is illustrated in equation 3.

$$\Delta m_{cb} = m_{next} - m_{aftertest} = -f(m_{aftertest}) \Big/ \left(\frac{\partial f}{dm}(m_{aftertest})\right) \tag{3}$$

The partial derivative, or slope of the sensor function, can be found by perturbing the system. This may be generally illustrated in equation 4, which represents the change in sensor measurements due to a test action ($\Delta m_{test} = m_{aftertest} - m_{beforetest}$).

$$\frac{\partial f}{\mathrm{dm}}(m_{aftertest}) = \frac{f(m_{aftertest}) - f(m_{beforetest})}{m_{aftertest} - m_{beforetest}} \tag{4}$$

Combining equations 3 and 4 may result in the generalized form shown in equation 5, which equation is generally expressed in an expanded notion of multiple inputs and outputs.

$$[f(m_{aftertest})] = -\left[\frac{\partial f(m)}{\partial m}\right] \cdot [\Delta m_{cb}] \tag{5}$$

Regarding the linear models and associated slope calculation in FIG. 1, it can be appreciated that a change in the mass may result in a change in the system, and the system itself may be nonlinear; thus, the linear model used to determine the next counterbalance may have significant error. Therefore, when applying the Newton Raphson iteration to a process, certain requirements should be followed. First, the initial approximation should be sufficiently accurate to result in subsequent operation near the desired solution. Also the measurement f(m) should be smooth, nearly linear and single-valued in the vicinity of the anticipated operation. Additionally, because higher derivatives are neglected in this type of approximation, the higher derivatives should be small, so as to avoid convergence problems.

Lastly, in applications of the Newton Raphson iteration, only one solution (counterbalance mass $\Delta m_{cb}$) should exist for the sensor measurement's being equal to zero. This means there is only one root. Even after following the above requirements, system noise may be a concern. In the hypothetical illustration of FIG. 2, a larger initial test action, which changes the system to point C, is preferable to the one that changes it to point B. This result can be illustrated by comparing the slopes of lines 22, 24 and 26, that result from the various test actions (perturbations) depicted in FIG. 2. The difference between the "before" and "after" test sensor measurements should be large enough to obtain a good approximation of the slope of the function, while ensuring that the resulting change in the measurement dominates the changes due to system noise.

Figure 3:
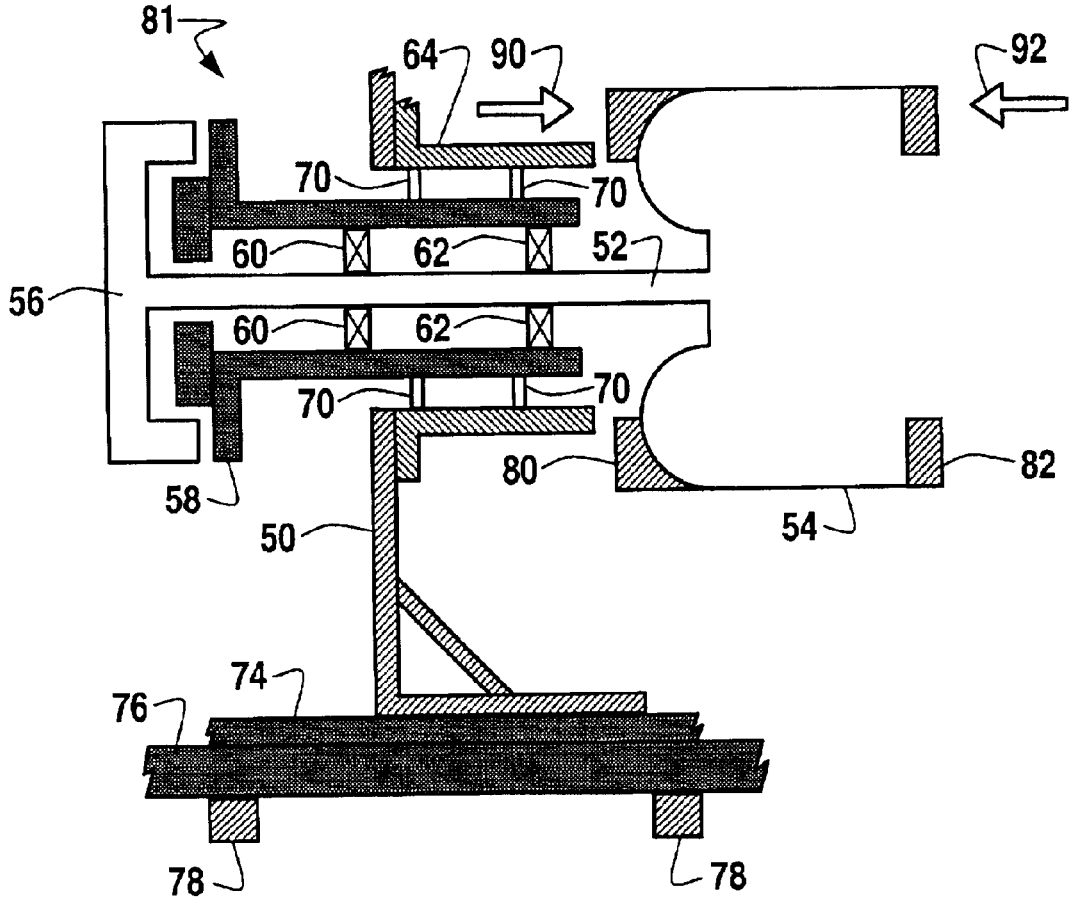
FIG. 3 depicts a schematic representation of a washing machine, which can be adapted for use in association with the present invention.

FIG. 3 depicts a schematic representation of a washing machine 81, which may be adapted for use in association with the present invention. Those skilled in the art can appreciate that the present invention may be implemented within a rotating device or rotating system, such as, for example, a washing machine. Those skilled in the art can further appreciate, however, that other types of rotating systems or rotating devices may be utilized in accordance with the present invention. Note that as utilized herein, the terms "rotating system," "rotating device," "rotating apparatus," "rotatable apparatus," "rotatable system," or "rotatable device" may be utilized interchangeably. Thus, a "self-balancing rotatable apparatus," for example, is one type of rotating system or rotating device that can be balanced in accordance with the methods and systems of the present invention. The methods and systems of the present invention may be implemented to balance rotating systems, rotating devices or rotating members thereof.

In the example of FIG. 3, a rotatable drum 54 includes a plurality of schematically illustrated back cups 80 and front cups 82. Both the back and front cups 80 and 82 may be disposed at axial ends of the rotatable drum 54 and, although not shown in FIG. 3, both the back and front cups 80 and 82 can comprise a plurality of cups dispersed around the periphery of rotatable drum 54. A quantity of water can be injected into back cups 80 and/or front cups 82 from a stationary control valve supplied with water, such as those identified by reference numerals 90 and 92. This water injection to the cups is the basic mechanism of dynamic balancing in embodiment described in FIG. 3. Although the terms test mass or fluid injection may be used to describe the preferred embodiment, those skilled in the art can appreciate that such a test or control action may be comprised of many different materials, and the invention is not limited to fluid-based injection methodologies for placing mass.

FIG. 3 thus schematically illustrates a washing machine 81 comprising a frame 50, a shaft 52 and a rotatable drum 54. Shaft 52 may be attached to rotatable drum 54. These two components can be attached to a rotor or pulley 56 of a motor drive. Frame 50 can provide support for a bearing housing 58 in which bearings 60 and 62 are generally supported. A housing mount 64 can support bearing housing 58. A plurality of sensors identified by the reference numeral 70 are illustrated between the housing mount and the bearing housing in FIG. 3. These sensors will be described in greater detail below. Beneath frame 50 are generally shown a carpet and pad 74, a plywood support member 76 and a plurality of joists 78. The representation shown in FIG. 3 illustrates a typical application of a horizontal washing machine in a residential housing environment. Those skilled in the art can appreciate that FIG. 3 is presented for illustrative purposes only and that a variety of washing machine configurations and other rotating devices not illustrated herein may be utilized to implement varying embodiments of the present invention. Washing machine 81 is thus described herein for illustrative purposes only and is not considered a limiting feature of the present invention.

Figure 2:
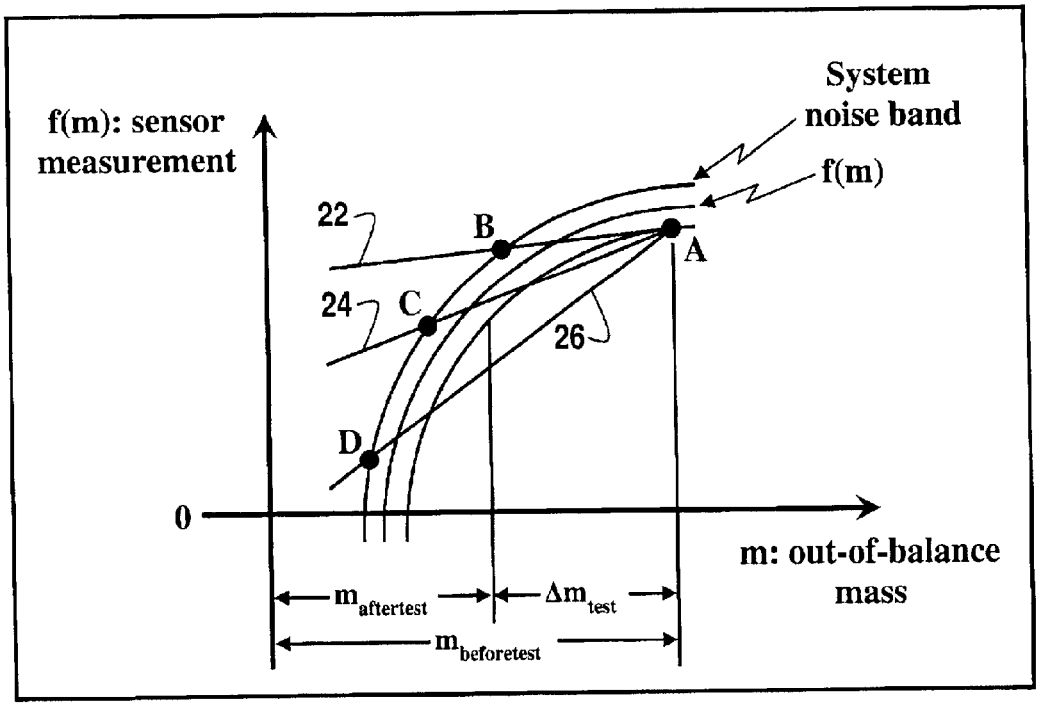
FIG. 2 illustrates a graphical representation of a nonlinear system and the effect of system noise with which the present invention must be concerned.
Figure 5:
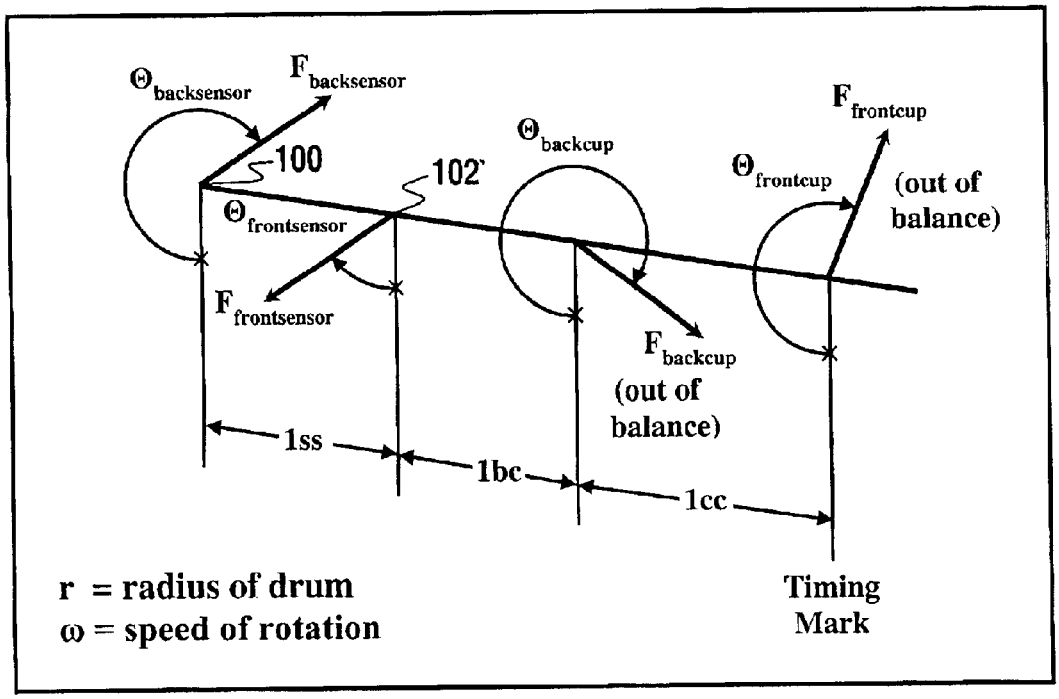
FIG. 5 depicts a three-dimensional schematic representation of the forces and critical lengths along an axis of rotation, which has been extended along a length of the shaft and through a length of the drum.

FIG. 5 illustrates a three-dimensional schematic representation of the forces and critical lengths along the axis of rotation, which has been extended along the length of the shaft and through the length of the drum. Force sensors may be mounted to measure the force transmitted between housing mount 64 and bearing housing 58, as illustrated in FIG. 2. The basic concept of dynamic balancing stipulates that vector forces at the front and back cups may represent an out-of-balance condition. Referring to FIG. 5, the system may be provided with a mechanism for sensing a first force $F_{backsensor}$ at a first location 100 of the axis of rotation and a second mechanism for measuring a second force $F_{frontsensor}$ at a second location 102 of the axis of rotation. It should be understood that both the first and second forces shown in FIG. 5 are likely to be determined from a plurality of force sensors arranged so the resultant force vectors along multiple axes of the system can be determined at each of the first and second locations, 100 and 102, of the axis of rotation.

If a washing machine or similar apparatus with a rotating member is rigidly attached to a stationary object, such as a concrete floor, a mere force and moment analysis based on forces and moment arms shown in FIG. 5 would be appropriate. This analysis would thus yield sufficient information to allow counterbalance forces to be implemented in a manner that would achieve a balance of a rotating drum 54. However, in most practical residential housing applications, the machine is not rigidly attached to an immovable object and, instead, may be associated with a plurality of flexible members. Therefore, it is not practical to expect a machine of this type to be installed and operate without motion being experienced by the various portions of the machine.

Figure 4:
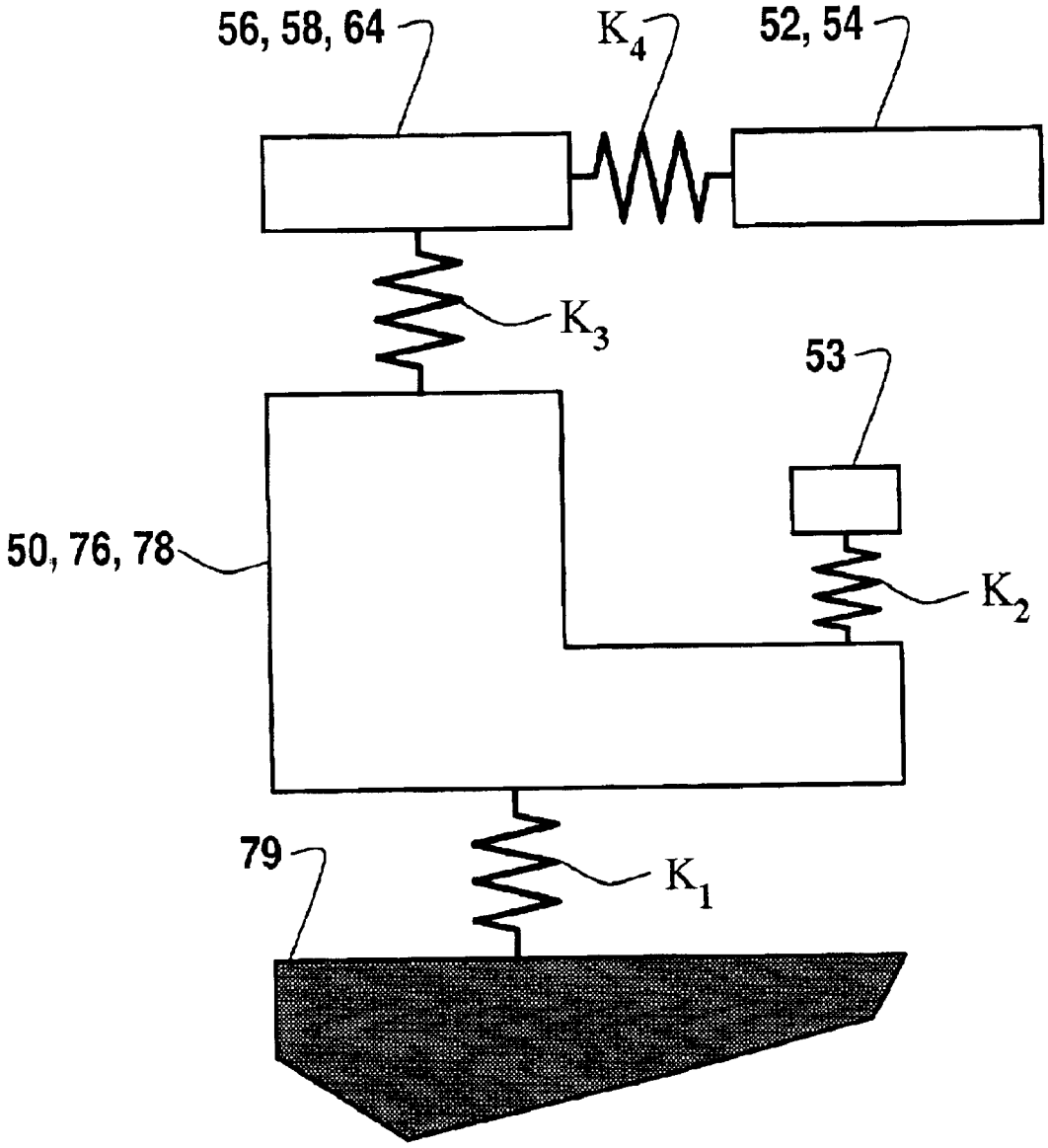
FIG. 4 illustrates a spring and mass illustration depicting the manner in which a non-rigid washing machine can behave if mounted on non-rigid structures.

FIG. 4, depicts a schematic representation of a type of arrangement usually encountered in washing machine applications. FIG. 4 thus illustrates a spring and mass system depicting the manner in which a nonrigid washing machine can behave if mounted on nonrigid structures. The behavior of frame 50 in relation to footing 79 can be described as a spring connecting the frame 50 and floor 76 to the footing 79 and having a spring constant K1. The relationship between a tub 53 (not shown in FIG. 3) surrounding the rotatable drum 54 and frame 50 can be described by a spring constant K2. A spring constant K3 represents the relationship among bearing housing 58 and housing mount 64 and frame 50 in FIG. 3. Lastly, FIG. 4 illustrates a spring constant K4 that represents the bending of shaft 52 along with rotatable members 54 and 56.

Although only represented by boxes in FIG. 4, the schematic illustration depicts a multitude of mass-spring subsystems that define the relationships among major components of the overall system. FIG. 4 demonstrates that the relationships between these components are not rigid and, as a result, can permit motion, resulting in accelerations, to occur in response to forces exerted on the various components. Therefore, measuring only the forces at sensors 70 shown in FIG. 3 would make accurate counterbalance determinations extremely difficult, if not impossible. Thus, it may be beneficial to measure motion relative to a footing or inertial space (e.g., acceleration) and account for it in the analysis of forces.

Figure 6:
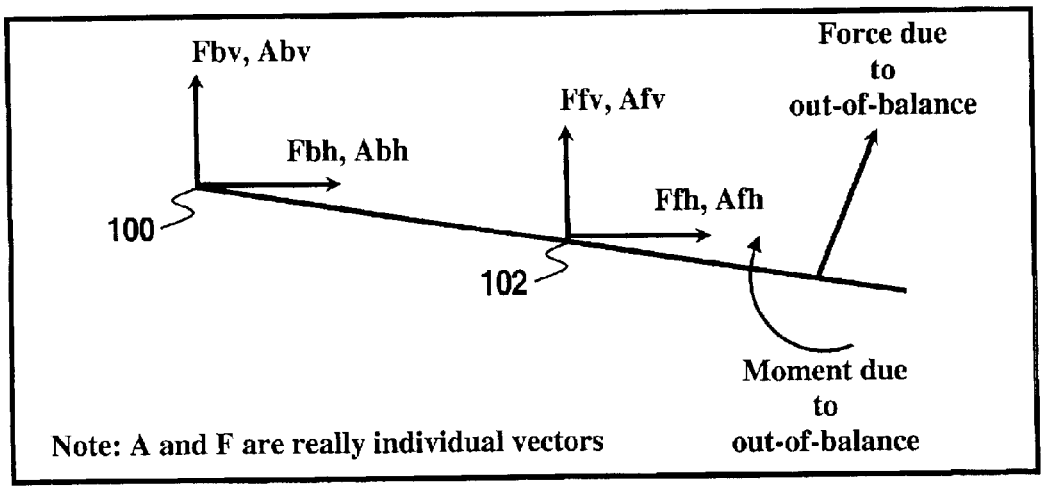
FIGS. 6 and 7 depict a graphical representation of a shaft with measured force and motion parameters.
Figure 7:
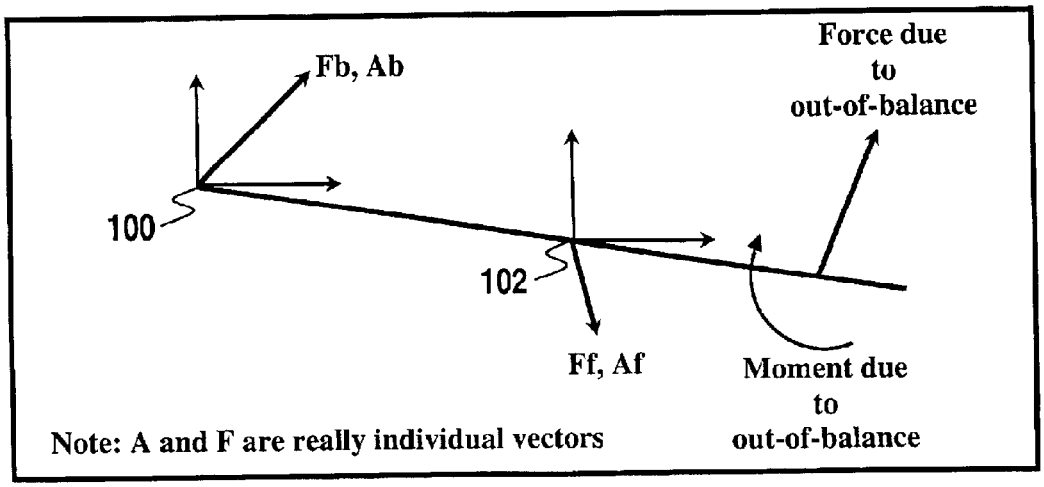

FIGS. 6 and 7 show the measurement of forces and accelerations in three-dimensional space at various locations along the shaft 52. Viewing FIGS. 6 and 7 together, it can be seen that the forces and accelerations can be measured at two coincident locations on the shaft 52. It can be appreciated, however, that this coincidence of the first force and the first acceleration or the second force and the second acceleration are not requirements of the present invention. At each of the first and second locations, 100 and 102, the effects of rotating out-of-balance forces are determined along the horizontal (h) and vertical (v) coordinates. Those skilled in the art can appreciate that the coordinates shown in FIGS. 6 and 7 illustrate the fact that the concepts taught in U.S. Pat. No. 5,561,993 and the present invention operate with information describing the forces and accelerations (motions) in terms of a magnitude along a fixed direction, and an associated rotating drum angle.

TABLE I

| VARIABLE | DESCRIPTION |
|---|---|
| Inputs | |
| $\Delta m_{front_cb}$ | Test counterbalance mass placed in the front plane (vector) |
| $\Delta m_{back_cb}$ | Test counterbalance mass placed in the back plane (vector) |
| $\omega_{back}$ | Speed of rotation in (rad/sec) at which the back plane test counterbalance occurred |
| $\omega_{front}$ | Speed of rotation in (rad/sec) at which the front plane test counterbalance occurred |
| R | Radius of counterbalance placement (inches) |
| $\omega$ | Current speed of rotation |
| Outputs | |
| $f_{back}$ | Back force sensor (lbf) (vector) |
| $f_{front}$ | Front force sensor (lbf) (vector) |
| $a_{back}$ | Back accelerometer sensor (in/sec$^2$) (vector) |
| $a_{front}$ | Front accelerometer sensor (in/sec$^2$) (vector) |
| Actions | |
| $m_{backplane_cb}$ | Estimated backplane counterbalance to drive sensor readings to zero (vector) |
| $m_{frontplane_cb}$ | Estimated frontplane counterbalance to drive sensor readings to zero (vector) |

For the following discussion, Table I illustrates the inputs and outputs utilized in the multi-input/multi-output condition relating to the invention described in U.S. Pat. No. 5,561,993. In order to find the appropriate solutions for the counterbalance forces described above, measured forces and accelerations should be considered in the balancing of system forces and moments. As described above, the counterbalance masses, forces and accelerations represent magnitudes and angles. Therefore, all variables shown in Table I, except r and $\omega$, generally comprise both a magnitude and an angle in polar coordinates, which can be converted to complex coordinates. The relationship described in equation 5 above can be rewritten for the multi-input/multi-output case using the terms described in Table I. The result is four coupled simultaneous equations, incorporating the effects of perturbations in both front and back planes that could have occurred at rotational speeds slightly different from the current speed. These four relationships are shown below and identified as equation 6.

$$a_{back4} = -\left(\frac{a_{back1} - a_{back0}}{r \cdot \omega_{back}^2 \cdot \Delta m_{\text{back_cb}}}\right) \cdot r \cdot \omega^2 \cdot m_{\text{backplane_cb}} - \left(\frac{a_{back3} - a_{back2}}{r \cdot \omega_{front}^2 \cdot \Delta m_{\text{front_cb}}}\right) \cdot r \cdot \omega^2 \cdot m_{\text{frontplane_cb}} \tag{6}$$

$$a_{front4} = -\left(\frac{a_{front1} - a_{front0}}{r \cdot \omega_{back}^2 \cdot \Delta m_{\text{back_cb}}}\right) \cdot r \cdot \omega^2 \cdot m_{\text{backplane_cb}} - \left(\frac{a_{front3} - a_{front2}}{r \cdot \omega_{front}^2 \cdot \Delta m_{\text{front_cb}}}\right) \cdot r \cdot \omega^2 \cdot m_{\text{frontplane_cb}}$$

$$f_{back4} = -\left(\frac{f_{back1} - f_{back0}}{r \cdot \omega_{back}^2 \cdot \Delta m_{\text{back_cb}}}\right) \cdot r \cdot \omega^2 \cdot m_{\text{backplane_cb}} - \left(\frac{f_{back3} - f_{back2}}{r \cdot \omega_{front}^2 \cdot \Delta m_{\text{front_cb}}}\right) \cdot r \cdot \omega^2 \cdot m_{\text{frontplane_cb}}$$

$$f_{front4} = -\left(\frac{f_{front1} - f_{front0}}{r \cdot \omega_{back}^2 \cdot \Delta m_{\text{back_cb}}}\right) \cdot r \cdot \omega^2 \cdot m_{\text{backplane_cb}} - \left(\frac{f_{front3} - f_{front2}}{r \cdot \omega_{front}^2 \cdot \Delta m_{\text{front_cb}}}\right) \cdot r \cdot \omega^2 \cdot m_{\text{frontplane_cb}}$$

The four mathematical relationships illustrated in equation 6 above can be grouped together and treated as a matrix equation in the following discussion. The meanings of the subscripts in equation 6 above are identified in Table II.

TABLE II

| SUBSCRIPT | MEANING |
|---|---|
| 0 | Measurement prior to back plane counterbalance test mass $\Delta m_{\text{back_cb}}$ |
| 1 | Measurement after back plane counterbalance test mass $\Delta m_{\text{back_cb}}$ |
| 2 | Measurement prior to front plane counterbalance test mass $\Delta m_{\text{front_cb}}$ |
| 3 | measurement after front plane counterbalance test mass $\Delta m_{\text{front_cb}}$ |
| 4 | current sensor measurement |

The relationships shown above in equation 6 can be applied to equation 5 in matrix form as:

$$\begin{bmatrix} a_{back4} \\ a_{front4} \\ f_{back4} \\ f_{front4} \end{bmatrix} = -\begin{bmatrix} \frac{a_{back1} - a_{back0}}{r \cdot \omega_{back}^2 \Delta m_{\text{back_cb}}} & \frac{a_{back3} - a_{back2}}{r \cdot \omega_{front}^2 \Delta m_{\text{front_cb}}} \\ \frac{a_{front1} - a_{front0}}{r \cdot \omega_{back}^2 \Delta m_{\text{back_cb}}} & \frac{a_{front3} - a_{front2}}{r \cdot \omega_{front}^2 \Delta m_{\text{front_cb}}} \\ \frac{f_{back1} - f_{back0}}{r \cdot \omega_{back}^2 \Delta m_{\text{back_cb}}} & \frac{f_{back3} - f_{back2}}{r \cdot \omega_{front}^2 \Delta m_{\text{front_cb}}} \\ \frac{f_{front1} - f_{front0}}{r \cdot \omega_{back}^2 \Delta m_{\text{back_cb}}} & \frac{f_{front3} - f_{front2}}{r \cdot \omega_{front}^2 \Delta m_{\text{front_cb}}} \end{bmatrix} \cdot \begin{bmatrix} m_{\text{backplane_cb}} \\ m_{\text{frontplane_cb}} \end{bmatrix} \cdot r \cdot \omega^2 \tag{7}$$

where we describe this matrix equation as being in the form b=Ax and $$A = -\frac{\partial f(m)}{\partial m} = -\begin{bmatrix} \frac{a_{back1} - a_{back0}}{r \cdot \omega_{back}^2 \cdot \Delta m_{\text{back_cb}}} & \frac{a_{back3} - a_{back2}}{r \cdot \omega_{front}^2 \cdot \Delta m_{\text{front_cb}}} \\ \frac{a_{front1} - a_{front0}}{r \cdot \omega_{back}^2 \cdot \Delta m_{\text{back_cb}}} & \frac{a_{front3} - a_{front2}}{r \cdot \omega_{front}^2 \cdot \Delta m_{\text{front_cb}}} \\ \frac{f_{back1} - f_{back0}}{r \cdot \omega_{back}^2 \cdot \Delta m_{\text{back_cb}}} & \frac{f_{back3} - f_{back2}}{r \cdot \omega_{front}^2 \cdot \Delta m_{\text{front_cb}}} \\ \frac{f_{front1} - f_{front0}}{r \cdot \omega_{back}^2 \cdot \Delta m_{\text{back_cb}}} & \frac{f_{front3} - f_{front2}}{r \cdot \omega_{front}^2 \cdot \Delta m_{\text{front_cb}}} \end{bmatrix} \tag{8}$$

Equations 6, 7 and 8 depict the mathematical model generally described in U.S. Pat. No. 5,561,993. This mathematical model is formulated such that the dynamics of the system are divided into two columns based on whether mass is placed in the front plane (i.e., column 2) or the back plane (i.e., column 1) of the spinner. The present invention disclosed herein may be used with this control model or like extensions, the more general solution of which allows for the placement of mass in both the front and the back planes simultaneously to formulate the control model and apply control actions. This more general control model solution is briefly discussed and used herein for describing the present invention.

In describing the more general control model solution, the model developed in equations 5, 6, and 7, takes on the general form shown in equation 9.

$$f(i+2) = -\left[\frac{f(i+1) - f(i)}{\|m(i+1) - m(i)\|} \quad \frac{f(i+2) - f(i+1)}{\|m(i+2) - m(i+1)\|}\right] \left[\frac{m(i+1) - m(i)}{\|m(i+1) - m(i)\|} \quad \frac{m(i+2) - m(i+1)}{\|m(i+2) - m(i+1)\|}\right]^{-1} \begin{bmatrix} \Delta m_{\text{back_cb}} \\ \Delta m_{\text{front_cb}} \end{bmatrix} \tag{9}$$

In equation 9 above, f(i) represents the $i^{th}$ sensor reading; f(i+2) is equivalent to $f(m_{aftertest})$ illustrated in equation 5. Also, m(i) may be a complex vector representing the force at the front and back planes of the rotating apparatus resulting from the $i^{th}$ test action. The equation Δm(I+1)=m(I+1)−m(i) may represent a complex vector of counter balance force or test actions applied to the spinner; each test action is formed by injecting simultaneously in the front and the back plane of the spinner. The A matrix (df(m)/dm) obtained from equation 5 is now represented by the relation shown in equation 10.

$$A = -\frac{\partial f}{\partial m(i)} = -\left[\frac{f(i+1) - f(i)}{\|m(i+1) - m(i)\|} \quad \frac{f(i+2) - f(i+1)}{\|m(i+2) - m(i+1)\|}\right] \left[\frac{m(i+1) - m(i)}{\|m(i+1) - m(i)\|} \quad \frac{m(i+2) - m(i+1)}{\|m(i+2) - m(i+1)\|}\right]^{-1} \tag{10}$$

Equation 11 below shows the A matrix for the more general control model solution, where 2 control actuators, or control planes, and 4 sensor readings are available as in the case described in equations 6–8.

$$A = -\begin{bmatrix} \frac{a_{back1} - a_{back0}}{\|\Delta m(1)_{cb}\|} & \frac{a_{back2} - a_{back1}}{\|\Delta m(2)_{cb}\|} \\ \frac{a_{front1} - a_{front0}}{\|\Delta m(1)_{cb}\|} & \frac{a_{front2} - a_{front1}}{\|\Delta m(2)_{cb}\|} \\ \frac{f_{back1} - f_{back0}}{\|\Delta m(1)_{cb}\|} & \frac{f_{back2} - f_{back1}}{\|\Delta m(2)_{cb}\|} \\ \frac{f_{front1} - f_{front0}}{\|\Delta m(1)_{cb}\|} & \frac{f_{front2} - f_{front1}}{\|\Delta m(2)_{cb}\|} \end{bmatrix}. \tag{11}$$

$$\begin{bmatrix} \frac{\Delta m(1)_{\text{back_cb}}}{\|\Delta m(1)_{cb}\|} & \frac{\Delta m(1)_{\text{back_cb}}}{\|\Delta m(2)_{cb}\|} \\ \frac{\Delta m(1)_{\text{front_cb}}}{\|\Delta m(1)_{cb}\|} & \frac{\Delta m(1)_{\text{front_cb}}}{\|\Delta m(2)_{cb}\|} \end{bmatrix}^{-1}$$

The equation relationships shown in equation 9 can be rearranged to solve for the counterbalance forces, $\Delta m_{back_cb}$ and $\Delta m_{front_cb}$, required to bring the system into balance. Utilizing the A matrix from equation 11 for the case of four sensors, a relationship can be expressed through equation 12 as follows:

$$\begin{bmatrix} \Delta m_{\text{back_cb}} \\ \Delta m_{\text{front_cb}} \end{bmatrix} = A^{+} \cdot \begin{bmatrix} a_{back} \\ a_{front} \\ f_{back} \\ f_{front} \end{bmatrix} \tag{12}$$

In a situation such as that described by equation 12 above, 4 sensor values (i.e., two accelerations and two forces) are known from measurements and two counterbalance forces are unknown. This results in a situation where there are more equations than unknowns as each sensor provides an equation and there are only two unknown counterbalance forces for the front and back planes of the drum. This condition describes an over-determined system. An over-determined system may have more than one possible solution and a technique is generally required to solve for more equations than unknowns in an optimal manner.

A technique for solving equations of this type in a balancing scheme should find a solution that minimizes all of the sensor readings and also minimizes the amount of counterbalance media required to balance the rotating system. In other words, the force sensors and the accelerometers should all be driven as close to zero as possible by the selected counterbalances and the total amount of counterbalance media (i.e., fluid or mass) applied should be minimized.

Those skilled in the art can appreciate that a mathematical technique which may solve this problem involves computation of the pseudo-inverse of the A matrix ($A^{+}$) utilizing the singular value decomposition (SVD) technique. This solution method finds the optimal solution to the over-determined system shown in equation 9. The SVD is one of several techniques that can support the pseudo-inverse calculation for control. It can provide optimal control for both inputs and outputs of the modeled system. Other variations of the components that make up the SVD may be used alone but would not provide both input and output optimization. This procedure is fully described in U.S. Pat. No. 5,561,993 and is well known to those skilled in the art. It is also described in significant detail in various reference linear algebra textbooks.

After generating the solution to equation 12, it may be necessary to formulate a practical approach to applying the counterbalance mass to the rotating member and then evaluating the member to verify that the control action had the desired balancing affect. An approach to applying counterbalance and verifying the control action effect is fully described in U.S. Pat. No. 5,561,993, which is incorporated herein by reference. Those skilled in the art can appreciate that the approaches to applying counterbalance and verifying the control action effect, which were disclosed in U.S. Pat. No. 5,561,993, do not limit the scope of the present invention. The features, techniques, methods and systems disclosed in U.S. Pat. No. 5,561,993 are described herein for illustrative and background purposes only.

In an ideal system, the force applied to the rotating portion of the member is linearly related to the force and motion that the sensors measure. In this ideal system the placement of the optimal counterbalances determined by solving the system in the manner described herein should drive all of the sensors to zero and achieve perfect balance of the rotating member. For various reasons, however, it is not expected that an ideal system exists and certain system-balance, operational safety, and physical constraints should be considered.

In applying counterbalance and verifying the control action in a preferred embodiment of the present invention, system-balance, operational safety, and physical constraints can be evaluated based on the concept of sensor measurement thresholds and metrics. In regard to the thresholds, the extremes are the balance threshold and the maximum threshold. The balance threshold defines the sensor level below which the rotating member is defined as being in a balanced state. The maximum threshold defines the sensor level above which the rotating member should not be for any extended length of time. Intermediate thresholds establish levels at which balance control versus speed control decisions get made. The system-balance and operational safety constraints may direct the top-level control sequence.

Physical limits and safety evaluation impact control actions between the balance and the maximum threshold levels. The control actuator applies a physical limit on the amount of input that can be applied to the system at any one time (smallest and largest), as does the physical design of the rotating member in terms of accommodating the counterbalance mass. These physical limits are evaluated in terms of their ability to affect sensor responses by an amount less than the balance threshold with sufficient room to operate (i.e., allow multiple control actions) within the balance-to-maximum threshold range. Given sufficient room to operate, the size and correctness of a recommended counterbalance action may be a safety concern. A large recommended counterbalance action or an incorrectly placed counterbalance may increase rather than decrease the degree of out-of-balance; as such, it may not be prudent to apply the entire counterbalance to the member in one control action. Thus, a set of limits may be used to safely apply the recommended counterbalance action to the rotatable member.

Conversely, system-balance constraints come into play when control actions, counterbalance or test, are used to create or update the control model as described above. As was previously discussed herein, the application of the Newton Raphson method requires that a control or test action should be large enough to provide a good approximation of slope, as illustrated in FIG. 2. System-balance constraints are associated with the non-linearity and time-varying nature of the system and its imbalance across operating speeds.

In addition to the system-balance, operational safety, and physical constraints imposed on the system, sensors utilized to evaluate the rotating system or rotating device requiring balancing generally can impose additional constraints, because the sensed forces and accelerations of interest actually comprise rotating vectors. That is, such rotating vectors are fixed with respect to the rotating members of the rotating system or rotating device requiring balancing and rotate at a rotational speed with respect to stationary members of the rotating system or rotating device. Thus, the desired information has a constant magnitude and angle relative to the rotating reference frame of the rotational members, which can then be superimposed by a periodic component relative to the stationary reference frame that supports the rotating members. In accordance with a preferred embodiment of the present invention, sensors for obtaining this information can be attached to the stationary members, as illustrated in FIGS. 3 and 5. It is important to understand that the present invention is not limited to this type of particular sensor attachment or sensor configuration but is described herein for illustrative purposes only. Depending on the dynamics of the rotating system or rotating device in question, not only can sensors be located on other parts of the stationary members but may also be mounted on parts of the rotating members of the rotating system or rotating device in question.

The signals from the sensor measurements may be comprised of a sinusoidal waveform with a constant offset bias and corrupted by measurement noise as well as harmonically-related system noise. The signal component of interest is the sinusoidal component at the frequency matching the speed of rotation. Known data acquisition techniques can be used to acquire the data in a digital format, including AC coupling to eliminate the constant offset bias, amplification as needed, and low-pass filtering to prevent aliasing in the event the data is digitized. Additional corruption of the sensor signals can be eliminated with a narrow band pass function that is tunable in real time to the speed of rotation. The band pass function also rejects external disturbances that can occur at frequencies other than the rotating frequency. Signal conditioning should introduce insignificant or known fixed delays to the sensed data. Certain aspects of the signal conditioning can be performed with analog or digital techniques.

The resultant sinusoidal signal contains the magnitude and angle information of interest and can be represented as pure sinusoidal signal as shown in equation 13. The magnitudes and angles for each sensor are the rotating vectors mentioned above. These complex sensor values or functions thereof can be the out-of-balance parameters. Some or all of whose magnitudes can be compared against threshold criteria to determine what further control action is required as discussed above.

$$x(t)=X\cos(\omega\cdot t+\delta) \tag{13}$$

X=Signal amplitude

ω=rotational speed in radian per second

δ=phase shift in radians

The sensor noise that can be evidenced in the sensor system can have an adverse effect on the control model when the sensor measurements or the change in the sensor measurements are comparable or smaller than the sensor or system noise. In such cases, an update of the control model, or use of an existing control model with recent sensor measurements, can interpret the sensor measurements as representing the system when in actuality they are dominated by noise. FIG. 2 shows how a change within the sensor noise band could cause the control algorithm to make an incorrect counterbalance estimate. This can result in a series of bad control model updates or misdirected balance control actions that minimally will take time to recover from but may also cause more serious problems. In testing the system this was observed to happen quite often.

Given the system of equations described above, $x=A^{+}b$, used to solve for the balance control action, those skilled in the art are aware that the condition of the $A^{+}$ matrix significantly impacts how sensor b, error (e.g., noise), impacts solution, x, error. Several methods can be used to manage the condition of $A^{+}$ and thereby reduce the impact of sensor noise. One approach manipulates the singular values from the SVD used to construct matrix $A^{+}$ such that a ratio of maximum-to-minimum singular value is maintained and smaller singular values are zeroed, a detailed explanation of which is provided in U.S. Pat. No. 5,561,993. However, this does not directly address circumstances of small sensor measurements or small changes in sensor measurement; having prior knowledge of the system and eliminating sensors operating within their error band or below their noise floor can improve control model updates and control action performance. The time-to-converge to a balanced state is improved because the sensor measurements used in developing the control better represent the system. Thus, the zeroing of these responses allows the rotating system to more quickly achieve a balanced state by eliminating extraneous control actions that are based on control actions having no appreciable perturbing effect on the rotating system. Those skilled in the art will appreciate that the noise floor and error band of a particular sensor can be obtained in a number of ways and the method by which this information is obtained does not in any way limit the scope of the present invention.

Data manipulation in terms of weighting sensor measurements can also be effective for constructing a more effective control model. As described in U.S. Pat. No. 5,561,993, which is incorporated herein by reference, the SVD technique for finding the pseudo-inverse in order to solve Ax=b for the desired control action will minimize the error between the sensor measurement vector b and its projection on the reduced order control space, Ax. This error can be further minimized by weighting the sensor measurements that make up the A matrix and b vector, prior to applying SVD, by a weighting matrix that establishes a relative importance between measurements from different sensors. U.S. Pat. No. 5,561,993 thus describes a weighting technique that normalizes sensor measurements to their respective balance thresholds, which were described above; the intent of this weighting was to essentially "level the playing field" for all sensors. Although effective, this technique is limited in that it simply deals with the size of the sensor response to the control action; a bigger response will mean a bigger impact on the control action solution, and vice versa.

The present invention improves on these prior art techniques by basing the applied weights on the absolute distance of the sensor response from its balance threshold level: a small sensor response further away from its balance threshold may be more significant than a large sensor response close to its balance threshold level. This weighting can be very useful when the system has one or two sensors that are farther away from the balance thresholds than others or when only one sensor is above the balance threshold. In a preferred embodiment of the present invention, this can be implemented by applying a weighting factor to sensors that are above their balance thresholds; the weighting factor can be constant or vary as a function of how far above their balance threshold the sensors are.

In a preferred embodiment of the present invention, a linear function may be utilized. This function has a minimum-weighting factor that is used when the sensor is just above the balance threshold and a maximum weighting that may be defined experimentally or analytically, used when the absolute sensor measures meet or exceed some designated level above balance threshold. The weighting can be calculated as shown in equations 14 and 15. In this case the weighting is set to maximum when equation 14 is greater than or equal to the maximum value. Those skilled in the art can appreciate that the simple implementation described herein is just one of many that may be implemented in accordance with one or more preferred or alternative embodiments of the present invention and does not limit the scope of the present invention.

$$sensor_weight = weight_ratio + MIN_WEIGHT \tag{14}$$

$$\text{weight_ratio}[i] = \frac{(\text{sensor}[i] - \text{balance_threshold}[i])}{\text{balance_threshold}[i]} \tag{15}$$

An additional sensor weighting improvement weights the sensor measurement, such that select sensors can be emphasized at different operating points (e.g. rotational speeds). The selection of sensors is generally based on prior system knowledge. In situations where a strong correlation exists between known operating conditions and modes of imbalance, and these modes of imbalance correlate well with select sensor measurements, schedules of weighting factors can be applied that allow the control to focus on high-impact sensor measurements associated with the current operating conditions. The weighting schedules can be determined in many ways and may be specific to a certain piece of rotating equipment or application thereof; this in no way limits the scope of the present invention.

Figure 8:
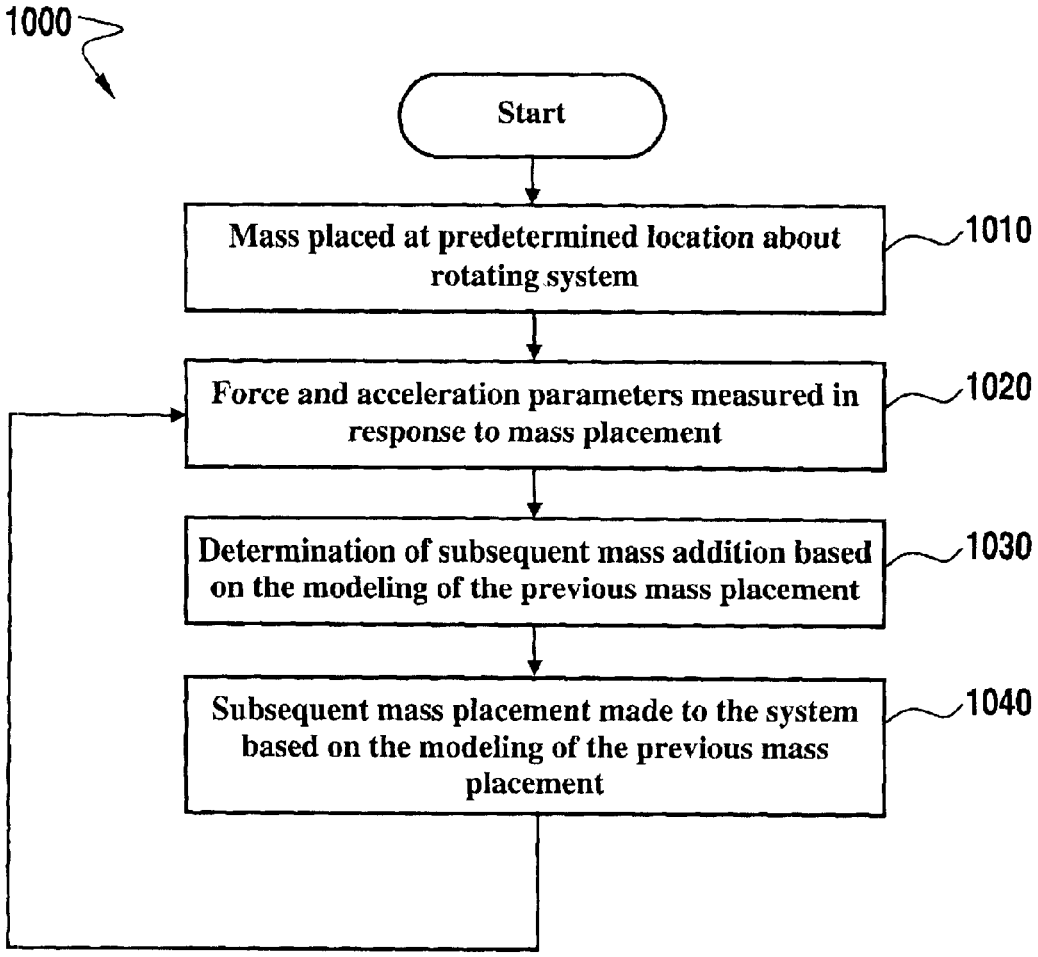
FIG. 8 illustrates a flow chart illustrating operational steps that can be utilized in accordance with the preferred embodiments of the present invention.
Figure 9:
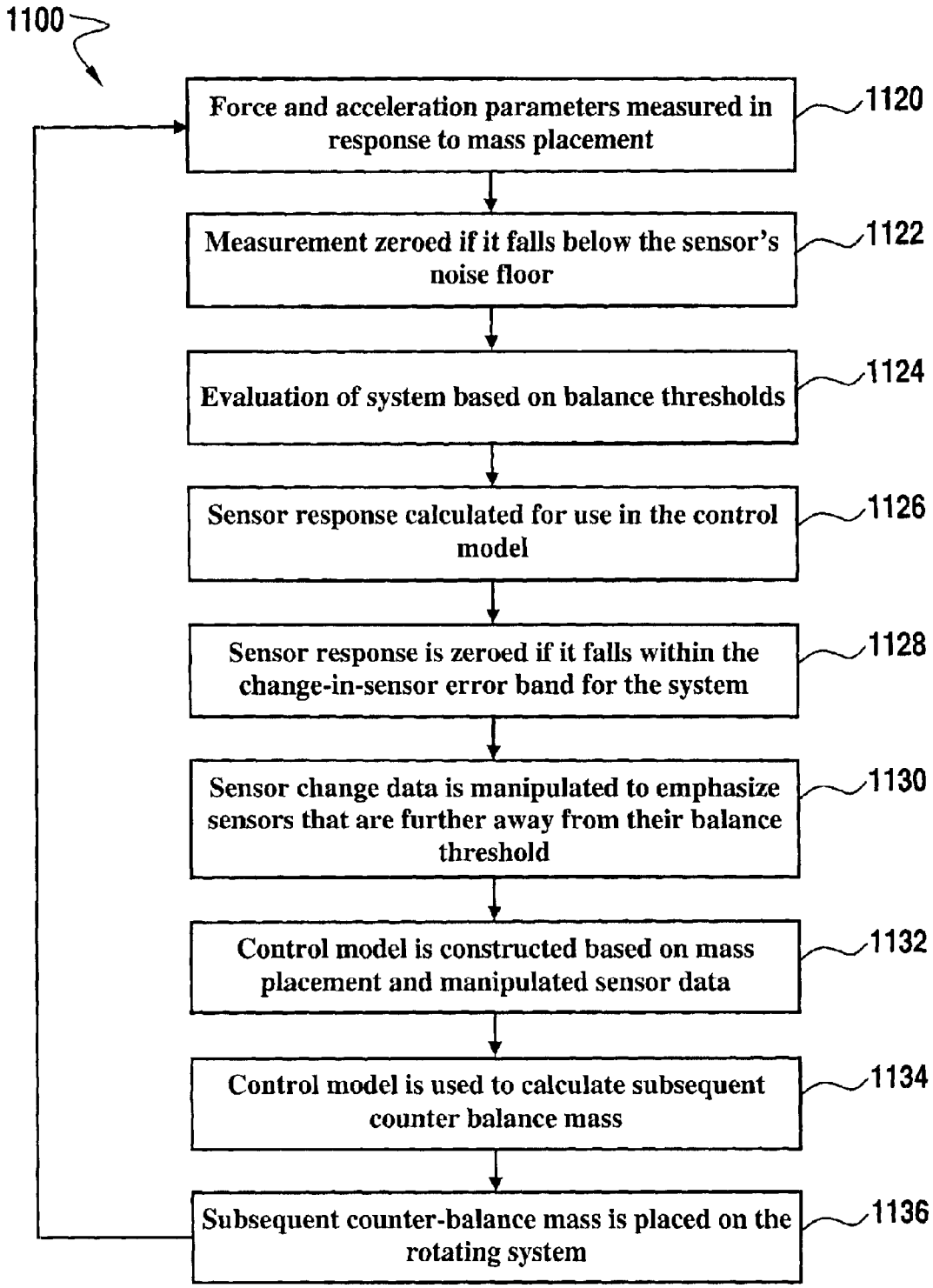
FIG. 9 depicts a high-level flow chart illustrating operational steps that can be utilized in accordance with the preferred embodiments of the present invention.

With the general approach and constraints to placing mass described, sensor measurements explained, and with new data manipulation techniques presented, consider FIG. 8 and FIG. 9, which depict high-level flow charts 1000 and 1100 illustrating operational steps that can be implemented in accordance with the present invention. Those skilled in the art can appreciate that flow charts 1000 and 1100 depict one possible operational method that can be utilized to implement an embodiment of the present invention and that other operational methodologies can also be utilized to implement embodiments of the present invention. Flow chart 1000 of FIG. 8 and flow chart 1100 of FIG. 9 are thus presented for illustrative purposes only. FIG. 8 and FIG. 9 depict general operational steps that may be followed to balance a rotating system or rotating device having a rotatable member and a shaft attached to the rotatable member. Balancing is generally based on the system response to concurrent control actions or injections to place mass at predetermined locations within the rotating system or rotating device.

In the descriptions of FIG. 8 and FIG. 9, reference is generally made to the placement of mass and measured sensor responses at predetermined locations within the rotating system or rotating device in question. This mass placement may be a result of one or more sufficiently different simultaneous injections of fluid into the front and back planes of the rotating body but may also include other methods of mass placement at other locations within the rotating system. In addition, the sensor measurements may include but are not limited to, forces and accelerations, parameters of the rotating system, such as displacement, velocity. Torsion may also be utilized in evaluating the system and calculating the control model. Also, the measured force and acceleration parameters may be utilized to calculate displacement, velocity, torsion, and other system parameters.

In the descriptions of FIG. 8 and FIG. 9 reference is also made to the control model and control actions. A control action refers to the placing of mass at predetermined locations within the rotating system, such that the system will tend toward a more balanced state. In accordance with one or more preferred or alternative embodiments of the present invention, a matrix calculation can be utilized to create a control model that in turn may be utilized to calculate a suitable control action.

Referring to FIG. 8, as illustrated at block 1010, a test or counterbalance action can result in mass placement at one or more predetermined locations in the rotating system. Thus, as illustrated at block 1020, a response to the placing of mass at the predetermined locations can be obtained by taking measurements of forces and accelerations exerted by the rotating system at predetermined locations. Then, as described at block 1030, the response to the placing of mass at predetermined locations can be modeled to determine a subsequent control action. Finally, as shown in block 1040, based on the modeling of the prior placement of mass at the predetermined locations, a subsequent mass placement can be made to the rotating system. This subsequent control action may be implemented as a desired counterbalance action required to place the rotating system in a balanced state. Those skilled in the art can appreciate that the process of modeling and placing masses can be repeated beyond the two mass additions described herein and that doing so may allow a more balanced state to be obtained.

FIG. 9 depicts a high-level flow chart 1100 of operations illustrating operational steps that may be processed in accordance with the present invention. The operations described in FIG. 9 illustrate further operational steps that can be followed to calculate the matrix model and may represent an expanded view of block 1030 of FIG. 8, wherein the modeling of the response from the plurality of sensors may be supplemented to include the additional operational steps. Accordingly, blocks 1020, 1030, and 1040 of FIG. 8 correspond generally to blocks 1120, 1134, and 1136 of FIG. 9.

Accordingly, as described in block 1122, the post-mass-placement sensor measurement can be zeroed if it falls below its respective noise-floor or specified multiple thereof. After the appropriate measurements are zeroed, the system can be evaluated based on the balance thresholds previously described herein and the change in sensor measurement based on the control or test action may be calculated as illustrated at block 1126. Following this sensor measurement change or response calculation certain sensor changes may be zeroed if the change falls within the sensor measurement error-band corresponding to the particular sensor of interest and the properties of the complete rotating system, as depicted at block 1128.

Following processing of the operational step described at block 1128, wherein the change in sensor measurement may be zeroed, the change in sensor measurement data may be further manipulated to emphasize select sensors, as indicated at block 1130. Utilizing this manipulated data, the control model can be calculated as described at block 1132, and thereafter utilized to generate a new control action as depicted at block 1134. Finally, this new control action can be applied to the system, as indicated at block 1136 and the process begins again, as described at block 1120, wherein forces and motion parameters are measured in response to the control action illustrated at block 1136.

Those skilled in the art will recognize that each of the additional steps described at blocks 1122, 1128, and 1130 of FIG. 9 are independent of each other and need not be implemented as a unit. They are capable of being implemented into the matrix determination separately as depicted at block 1132. Thus, a matrix determination or other modeling techniques utilizing one, some, or all of the additional steps described herein generally falls within the contemplated scope and spirit of the present invention.

Based on the foregoing, those skilled in the art can appreciate that the present invention overcomes problems derived from long spin-up times associated with balancing a rotating apparatus or system. Previous solutions to these problems did not address issues concerning sensor accuracy or system noise levels. By preferring some control action responses to other control action responses, fewer control actions are needed to bring the system into a balanced condition. By requiring fewer control actions to achieve this balanced condition, the time required for the apparatus to achieve a balanced condition can be reduced. This allows the rotating system to more quickly accelerate to its maximum rotational velocity.

Note that as utilized herein, the term "rotatable apparatus," "rotatable system," "rotating system," or "rotating device" may be utilized interchangeably to describe generally a machine, such as a washing appliance or centrifuge system, requiring balancing. The invention described herein can thus be applicable to any centrifuge operation requiring a balanced condition. Those skilled in the art can thus appreciate that the invention described herein is not limited to uses in which the action of fluid is utilized to achieve a balanced condition but can be implemented in any embodiment in which any type of balancing substance can be placed in a known location on a rotating system or rotating apparatus with one or more possible input planes.

The embodiments and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive or to limit the scope of the invention. For example, those skilled in the art can appreciate that the methods described herein, including mathematical formulations, can be implemented as a program product in the form of varying software modules, routines, and subroutines. Many modifications and variations are possible in light of the above teaching without departing from the scope of the following claims. It is contemplated that the use of the present invention can involve components having different characteristics. It is intended that the scope of the present invention be defined by the claims appended hereto, giving full cognizance to equivalents in all respects.

The embodiments of an invention in which an exclusive property or right is claimed are defined as follows:

1. A method for dynamically balancing a rotating system, wherein said rotating system includes sensors whose measurements and responses to control actions are utilized to represent said rotating system through a control model, such that said control model and said sensor measurements are determinative of future control actions, said method comprising the steps of:

perturbing said rotating system utilizing a control action while improving a balance condition associated with said rotating system;

compiling sensor measurements and responses to control actions utilizing at least one sensor associated with said rotating system; and manipulating said sensor measurements and said responses to control actions to thereby improve a dynamic balance control performance of said rotating system.

2. The method of claim 1 wherein the step of compiling sensor measurements and responses to control actions further comprises the step of:

measuring sensor data from at least one sensor associated with said rotating system; and determining at least one response thereof based on said control action.

3. The method of claim 1 wherein the step of manipulating said sensor measurement and response data, further comprises the steps of:

modifying sensor data collected from said at least one sensor in order to remove measurements and responses thereof that do not well represent said rotating system; and weighting said sensor data in order to emphasize and de-emphasize select sensors.

4. The method of claim 3 further comprising the step of: modeling said rotating system utilizing manipulated and weighted sensor data in order to determine at least one subsequent control action for driving said rotating system toward a balanced state.

5. The method of claim 3 further comprising the step of: zeroing at least one measurement from said at least one sensor, if said measurement falls below at least one multiple of a measurement noise-floor.

6. The method of claim 3 further comprising the step of: zeroing a response to a control action that falls below at least one multiple of a sensor measurement accuracy.

7. The method of claim 3 further comprising the step of: weighting said at least one response such that responses having a greater effect on a balanced state of said rotating system are preferred over responses having a lesser effect on said balanced state, such that a weighted response has an increased impact on a control model the further a respective absolute sensor measurement data is from a balance threshold.

8. The method of claim 3 further comprising the step of: weighting said at least one response such that select sensors associated with said rotating system are emphasized at varying operational conditions of said rotating system.

9. The method of claim 3 further comprising the step of: weighting said at least one response such that select sensors associated with said rotating system are de-emphasized at varying operational conditions of said rotating system.

10. A method for dynamically balancing a rotating system facilitated by sensor measurement data manipulation, wherein sensor measurements and responses to control actions are utilized to represent said rotating system through an associated control model, such that said control model and said sensor measurements are determinative of future control actions, thereby permitting said rotating system to be dynamically balanced, said method comprising the steps of:

perturbing said rotating system utilizing a control action while improving a balance condition associated with said rotating system;

measuring sensor data from at least one sensor associated with said rotating system;

determining at least one response thereof based on said control action;

manipulating sensor data collected from said at least one sensor in order to remove measurements and responses thereof that do not well represent said rotating system;

weighting said sensor data in order emphasize and de-emphasize select sensors; and modeling said rotating system utilizing manipulated and weighted sensor data in order to determine at least one subsequent control action for driving said rotating system towards a balanced state.

11. The method of claim 10 further comprising the step of: zeroing said at least one measurement from said at least one sensor, if said measurement falls below at least one multiple of a measurement noise-floor.

12. The method of claim 11 further comprising the step of: zeroing a response to a control action that falls below at least one multiple of a sensor measurement accuracy.

13. The method of claim 1 further comprising the step of zeroing a change in sensor measurement data.

14. The method of claim 12 further comprising the steps of:

further manipulating said change in sensor measurement data to emphasize select sensors; and generating manipulated data thereof.

15. The method of claim 14 further comprising the steps of:

calculating a control model utilizing said manipulated data; and utilizing said control model to generated updated control actions to be performed upon said rotating system.

16. The method of claim 15 further comprising the steps of: applying said updated control actions to said rotating system; and thereafter measuring forces and motion parameters associated with said rotating system in response to applying said updated control actions to said rotating system.

17. The method of claim 10 further comprising the steps of:

zeroing a change in sensor measurement data;

further manipulating said change in sensor measurement data to emphasize select sensors;

generating manipulated data thereof;

calculating a control model utilizing said manipulated data; and utilizing said control model to generated updated control actions to be performed upon said rotating system.

18. The method of claim 17 further comprising the steps of: applying said updated control actions to said rotating system; and thereafter measuring forces and motion parameters associated with said rotating system in response to applying said updated control actions to said rotating system.

19. A method for dynamically balancing a rotating system facilitated by sensor measurement data manipulation, wherein sensor measurements and responses to control actions are utilized to represent said rotating system through an associated control model, such that said control model and said sensor measurements are determinative of future control actions, thereby permitting said rotating system to be dynamically balanced, said method comprising the steps of:

perturbing said rotating system utilizing a control action while improving a balance condition associated with said rotating system;

measuring sensor data from at least one sensor associated with said rotating system;

determining at least one response thereof based on said control action;

manipulating sensor data collected from said at least one sensor in order to remove measurements and responses thereof that do not well represent said rotating system;

weighting said sensor data in order emphasize and de-emphasize select sensors;

modeling said rotating system utilizing manipulated and weighted sensor data in order to determine at least one subsequent control action for driving said rotating system towards a balanced state; zeroing a change in sensor measurement data;

further manipulating said change in sensor measurement data to emphasize select sensors;

generating manipulated data thereof;

calculating a control model utilizing said manipulated data; and utilizing said control model to generated updated control actions to be performed upon said rotating system.

20. The method of claim 19 further comprising the step of applying said updated control actions to said rotating system; and thereafter measuring forces and motion parameters associated with said rotating system in response to applying said updated control actions to said rotating system.

* * * * *